US010286531B2

(12) United States Patent
Hu et al.

(10) Patent No.: US 10,286,531 B2
(45) Date of Patent: May 14, 2019

(54) COMBINATION INCLUDING A RATCHET WRENCH AND A DRIVING MEMBER

(71) Applicant: Bobby Hu, Taichung (TW)

(72) Inventors: Bobby Hu, Taichung (TW); Chi-Jui Lo, Taichung (TW)

(73) Assignee: Bobby Hu, Taichung (TW)

( * ) Notice: Subject to any disclaimer, the term of this patent is extended or adjusted under 35 U.S.C. 154(b) by 924 days.

(21) Appl. No.: 14/503,463

(22) Filed: Oct. 1, 2014

(65) Prior Publication Data

US 2016/0059394 A1 Mar. 3, 2016

(30) Foreign Application Priority Data

Aug. 27, 2014 (TW) ..... 103129496 A

(51) Int. Cl.

| | |
|---|---|
| ***B25B 13/46*** | (2006.01) |
| ***B25B 13/56*** | (2006.01) |
| ***B25B 15/00*** | (2006.01) |
| ***B25B 23/00*** | (2006.01) |
| *B25B 13/06* | (2006.01) |
| *B25B 23/10* | (2006.01) |

(52) U.S. Cl.

CPC ..... *B25B 23/0035* (2013.01); *B25B 13/463* (2013.01); *B25B 13/56* (2013.01); *B25B 15/001* (2013.01); *B25B 15/008* (2013.01); *B25B 13/06* (2013.01); *B25B 13/46* (2013.01); *B25B 23/101* (2013.01); *B25B 23/105* (2013.01); *B25B 23/108* (2013.01)

(58) Field of Classification Search

CPC ..... B25G 3/00; B25B 23/0035; B25B 13/463; B25B 13/56; B25B 15/001; B25B 15/008; B25B 23/10; B25B 23/101; B25B 23/105; B25B 23/108; B25B 23/0071; B25B 13/06; B25B 13/46

USPC .... 81/60, 125, 61–63.2, 436–439; D8/85–87

See application file for complete search history.

(56) References Cited

U.S. PATENT DOCUMENTS

| | | | | |
|---|---|---|---|---|
| 5,499,560 A * | 3/1996 | Aeschliman | ..... | B25B 13/463 81/177.2 |
| 7,055,409 B2 * | 6/2006 | Hsien | ..... | B25B 13/463 81/177.8 |
| 8,215,208 B2 * | 7/2012 | Blackston | ..... | B25B 13/481 81/177.75 |

(Continued)

*Primary Examiner* — Monica S Carter
*Assistant Examiner* — Katina N. Henson
(74) *Attorney, Agent, or Firm* — Alan D. Kamrath; Kamrath IP Lawfirm, P.A.

(57) ABSTRACT

A combination includes a ratchet wrench and a driving member. The ratchet wrench includes a body and a ratchet wheel mounted in the body and rotatable relative to the body about a rotational axis. A driving hole extends through from a side through the other side of the body along the rotational axis and includes an inner periphery having a plurality of abutment surfaces. A corner is formed between each two adjacent abutment surfaces. At least one limiting portion protrudes from the inner periphery of the driving hole in a radial direction perpendicular to the rotational axis. The driving member includes at least one evasive portion and is coupled to the driving hole. The driving member is movable between a first coupling position and a second coupling position along the rotational axis when the at least one evasive portion is aligned with the at least one limiting portion.

10 Claims, 19 Drawing Sheets

(56) References Cited

U.S. PATENT DOCUMENTS

| | | | | |
|---|---|---|---|---|
| 2007/0113711 | A1* | 5/2007 | Tuan Mu | B25B 13/463 81/63.2 |
| 2007/0144311 | A1* | 6/2007 | Hsieh | B25B 13/06 81/121.1 |
| 2014/0238505 | A1* | 8/2014 | Petersen | F16K 15/202 137/223 |
| 2014/0311302 | A1* | 10/2014 | Taguchi | B25B 23/0035 81/437 |

* cited by examiner

COMBINATION INCLUDING A RATCHET WRENCH AND A DRIVING MEMBER

BACKGROUND

The present invention relates to a combination of a ratchet wrench and a driving member and, more particularly, to a combination of a ratchet wrench and a driving member detachably coupled to the ratchet wrench.

A ratchet wrench generally includes a body and a ratchet wheel rotatably received in the body. The ratchet wheel can directly couple with a fastener, such as a screw, a nut, etc. In another use, the ratchet wheel can couple with an end of an extension rod, and the other end of the extension rod is coupled with a fastener. In a further use, the ratchet wrench can couple with a bit for driving a fastener.

When the ratchet wrench is directly coupled with a nut, the nut is apt to pass from an end of the ratchet wheel through the other end of the ratchet wheel, leading to inconvenience to a user, because the user has to keep the nut in the ratchet wheel while rotating the body.

When the ratchet wrench is coupled with an extension rod, a C-shaped retainer ring in the ratchet wheel is coupled with notches in an end of the extension rod, and the other end of the extension rod is inserted into a hole in which a fastener is received. Thus, the user can rotate the body to tighten or loosen the fastener. However, the coupling force between the C-shaped retainer ring and the notches of the extension rod is insufficient such that the ratchet wheel is apt to slide relative to the extension rod. As a result, the end of the extension rod is apt to extend from an end of the ratchet wheel through the other end of the ratchet wheel, leading to inconvenience to the user. Furthermore, the spacing between the ratchet wrench and the hole cannot be adjusted. Namely, the extension rod can only be used with holes of a certain depth. In a case that a longer extension rod is inserted into a shallower hole, a considerable length of the extension rod will be exposed outside of the hole and will cause inconvenience to the user, because the exposed portion of the extension rod will sway while the user is rotating the ratchet wrench for driving the fastener in the hole.

Thus, a need exists for a novel combination of a ratchet wrench and a driving member to mitigate and/or obviate the above disadvantages.

BRIEF SUMMARY

This need and other problems in the field of reliable ratchet wrenches are solved by a combination including a ratchet wrench and a driving member.

In a first aspect, a combination includes a ratchet wrench and a driving member. The ratchet wrench includes a body and a ratchet wheel. The ratchet wheel is mounted in the body and is rotatable about a rotational axis relative to the body. The ratchet wheel includes a first side and a second side spaced from the first side along the rotational axis. The ratchet wheel further includes a driving hole extending from the first side through the second side. The driving hole includes an inner periphery having a plurality of abutment surfaces contiguous to each other and arranged along a circumferential direction about the rotational axis. A first corner is formed between each two adjacent abutment surfaces of the driving hole. At least one limiting portion protrudes from the inner periphery of the driving hole in a radial direction perpendicular to the rotational axis and is formed in at least one of the first corners.

The driving member includes a first end, a second end, and a connecting section. The connecting section includes an outer periphery having a plurality of abutment faces contiguous to each other. A second corner is formed between each two adjacent abutment faces of the connecting section. The connecting section includes at least one evasive portion between two adjacent abutment faces. The at least one evasive portion includes an evasive face having two sides respectively connected to the two adjacent abutment faces. The connecting section is adapted to be coupled with the driving hole of the ratchet wheel by extending along the rotational axis. The plurality of abutment faces of the connecting section abuts the plurality of abutment surfaces of the driving hole. The connecting section is located in one of a first coupling position and a second coupling position relative to the ratchet wheel.

When the driving member is in the first coupling position, the first end of the driving member abuts the at least one limiting portion of the ratchet wheel, and the at least one evasive portion is not aligned with the at least one limiting portion. On the other hand, when the driving member is in the second coupling position, the first end and the second end of the driving member are located on two sides of the ratchet wheel along the rotational axis, and the at least one evasive portion is aligned with the at least one limiting portion.

The number of the first corners of the driving holes can be equal to the number of the plurality of abutment surfaces of the driving hole. The number of the second corners of the connecting section is equal to the number of the plurality of abutment faces of the connecting section. The at least one limiting portion can be located adjacent to the first side of the ratchet wheel. The ratchet wheel can further include a retaining groove in an outer periphery thereof. The retaining groove is located adjacent to the second side of the ratchet wheel and intercommunicates with the driving hole. A retainer ring is engaged in the retaining groove and extends into the driving hole.

The retaining groove can include two coupling sections parallel to each other. Each of the two coupling sections intercommunicates with the driving hole. The retainer ring includes two longer sides and a shorter side. Each of the two longer sides has first and second ends. The shorter side is interconnected between the first ends of the two longer sides. An opening is defined between the second ends of the two longer sides. The two longer sides respectively engage with the two coupling sections of the retaining groove and extend into the driving hole. Each of the two longer sides has an axial spacing to the at least one limiting portion along the rotational axis. An extending direction of each of the two longer sides is parallel to an extending direction of the at least one limiting portion. The shorter side engages with the retaining groove. The connecting section of the driving member includes at least two first coupling grooves respectively defined in at least two of the second corners and at least two second coupling grooves respectively defined in at least two of the second corners. Each of the at least two first coupling grooves is spaced from each of the at least two second coupling grooves by a length along the rotational axis.

When the driving member is in the first coupling position, the two longer sides engage with the at least two first coupling grooves. On the other hand, when the driving member is in the second coupling position, the two longer sides engage with the at least two second coupling grooves. When the driving member moves from the first coupling position to the second coupling position or from the second coupling position to the first coupling position, the driving member moves relative to the ratchet wheel by a distance along the rotational axis equal to the length.

In an example, the connecting section is located between the first end and the second end of the driving member. Each of the plurality of abutment faces of the connecting section has a first width. The evasive face of the at least one evasive portion has a second width smaller than the first width.

The at least one evasive portion can extend from the first end through the second end of the driving member. Each of the two sides of the evasive face of the at least one evasive portion is at a first angle to a corresponding one of the two adjacent abutment faces. Each second corner of the connecting section has a second angle smaller than the first angle.

In an example, the at least one limiting portion has rectangular cross sections parallel to the rotational axis.

In an example, each first corner of the driving hole has a first spacing to the rotational axis. Each second corner of the connecting section has a second spacing to the rotational axis. The at least one limiting portion of the ratchet wheel has a third spacing to the rotational axis. The at least one evasive portion of the driving member includes a fourth spacing to the rotational axis. Each of the two longer sides of the retainer ring has a fifth spacing to the rotational axis. The first spacing is larger than the second spacing, the second spacing is larger than the third spacing, the third spacing is larger than the fourth spacing, and the fourth spacing is larger than the fifth spacing.

In an example, the at least one limiting portion includes three limiting portions. The plurality of abutment surfaces has six abutment surfaces. The driving hole has six first corners. The three limiting portions are respectively located in three of the six first corners not adjacent to each other. The plurality of abutment faces has six abutment faces. The connecting section has six second corners. The at least one evasive portion includes three evasive portions. The three evasive portions are respectively located in three of the six second corners not adjacent to each other.

In an example, the connecting section further includes at least one third coupling groove in one of the six second corners. The at least two first coupling grooves is located between the at least two second coupling grooves and the first end of the driving member. The at least one third coupling groove is located between the second end of the driving member and the at least two second coupling grooves.

The ratchet wheel can further include an operative portion, and the body is pivotably connected to the operative portion and is positionable relative to the operative portion.

In a second aspect, a driving member includes a first end, a second end, and a connecting section. The connecting section includes an outer periphery having a plurality of abutment faces contiguous to each other. A corner is formed between each two adjacent abutment faces of the connecting section. The connecting section includes at least one evasive portion between two adjacent abutment faces. The at least one evasive portion includes an evasive face having two sides respectively connected to the two adjacent abutment faces.

In a third aspect, a combination includes a ratchet wrench and a driving member. The ratchet wrench includes a body and a ratchet wheel. The ratchet wheel is mounted in the body and is rotatable about a rotational axis relative to the body. The ratchet wheel includes a first side and a second side spaced from the first side along the rotational axis. The ratchet wheel further includes a driving hole extending from the first side through the second side. The driving hole includes an inner periphery having six abutment surfaces contiguous to each other and arranged along a circumferential direction about the rotational axis. A corner is formed between each two adjacent abutment surfaces of the driving hole. A limiting portion protrudes from the inner periphery of the driving hole in a radial direction perpendicular to the rotational axis and is formed in one of the corners. The limiting portion is located adjacent to the first side of the ratchet wheel. The ratchet wheel further includes a retaining groove in an outer periphery thereof. The retaining groove is located adjacent to the second side of the ratchet wheel and intercommunicates with the driving hole. A retainer ring is engaged in the retaining groove and extends into the driving hole.

The driving member is detachably coupled with the retainer ring. The driving member includes a first end, a second end, and a connecting section located between the first end and the second end. The connecting section includes an outer periphery having six abutment faces. The connecting section is detachably coupled with the driving hole of the ratchet wheel. The plurality of abutment faces of the connecting section abuts the plurality of abutment surfaces of the driving hole. The first end of the driving member abuts the limiting portion of the ratchet wheel. The driving member cannot pass through the driving hole along the rotational axis in any angular position relative to the ratchet wheel.

The connecting section of the driving member can include at least two coupling grooves. The retainer ring is detachably coupled with the at least two coupling grooves of the driving member.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
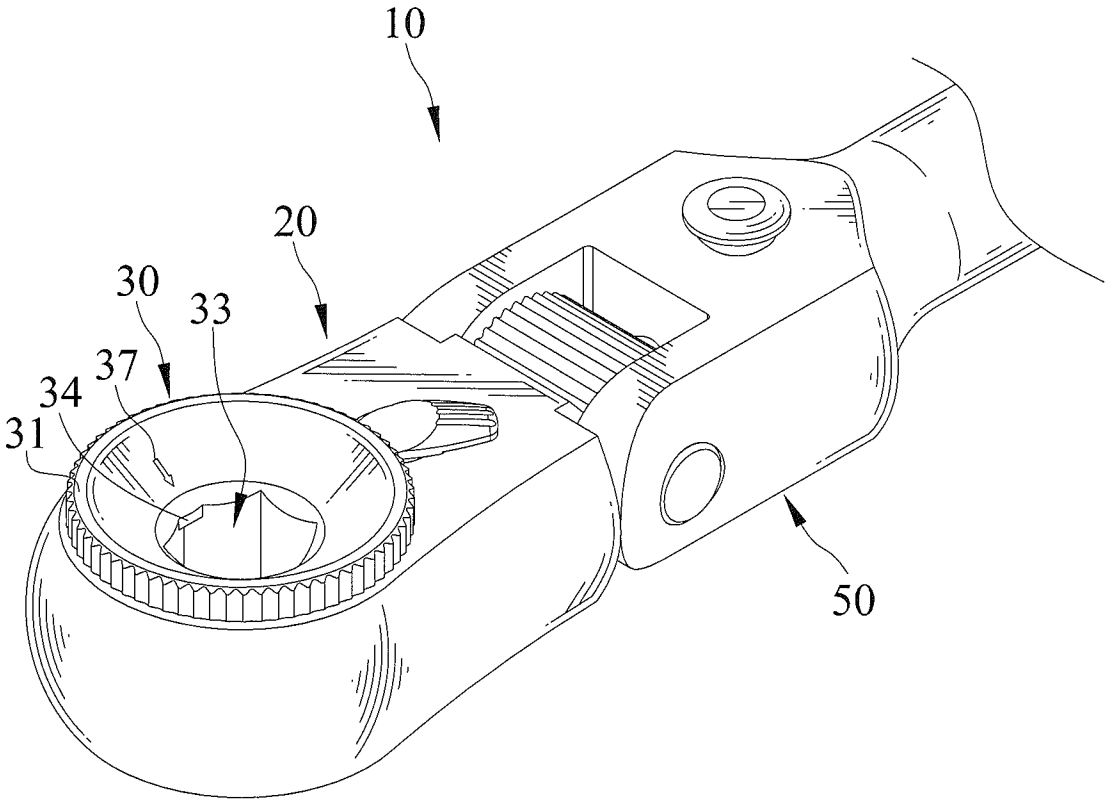
FIG. 1 is a partial, perspective view of a ratchet wrench of a combination of a first embodiment according to the present invention.
Figure 2:
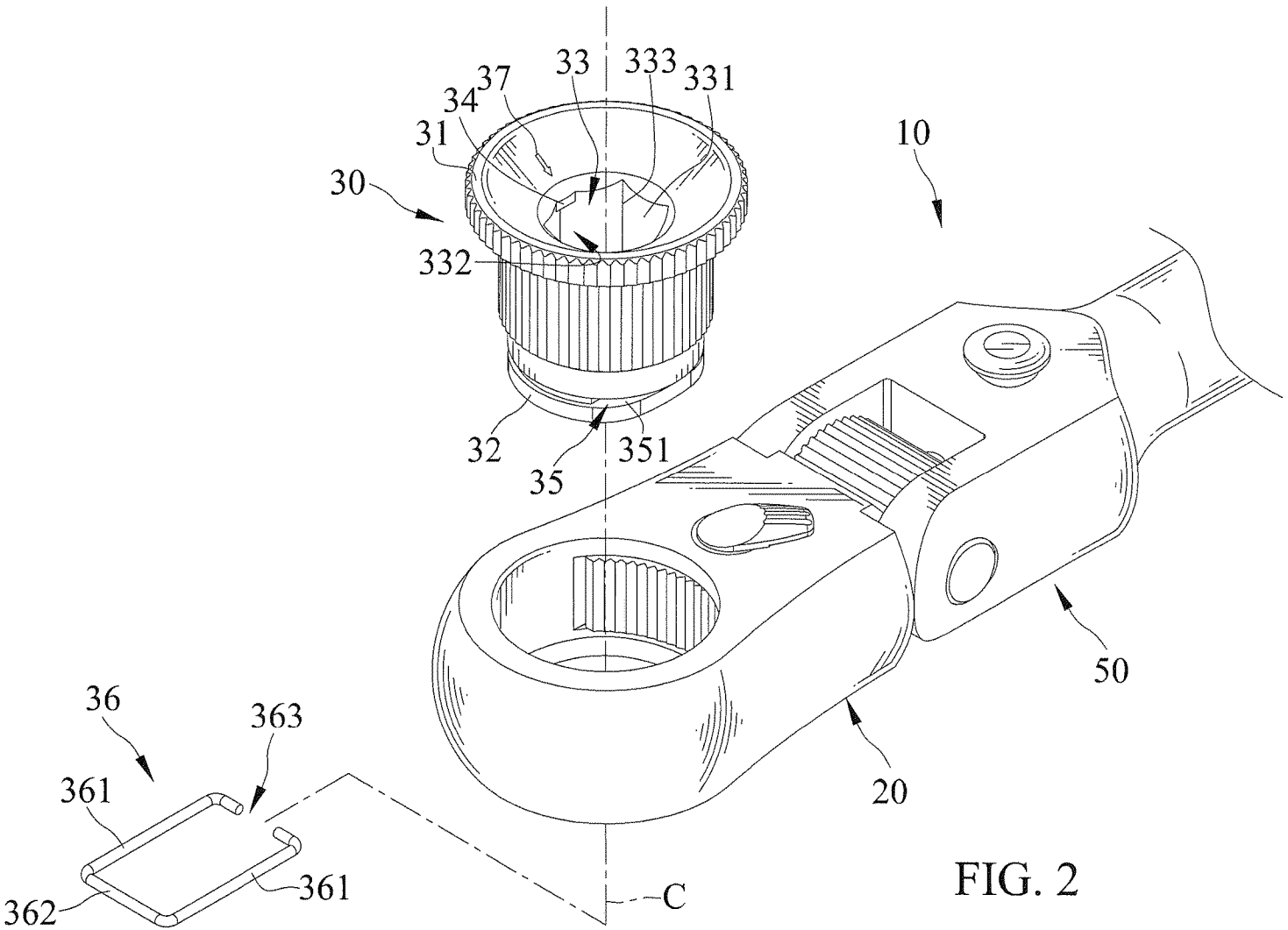
FIG. 2 is a partial, exploded, perspective view of the ratchet wrench of FIG. 1.
Figure 3:
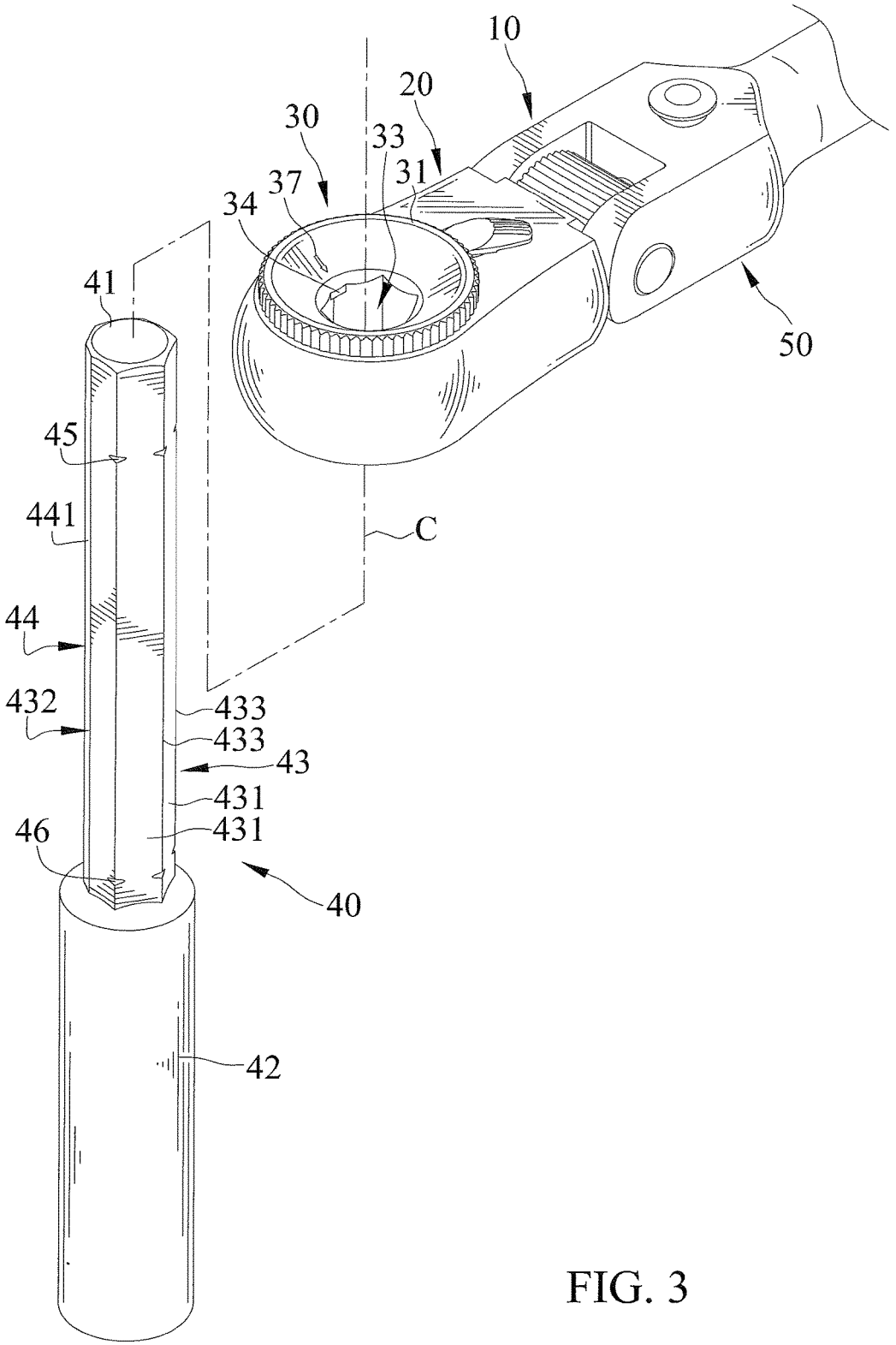
FIG. 3 is an exploded, perspective view of the combination of the first embodiment according to the present invention.
Figure 4:
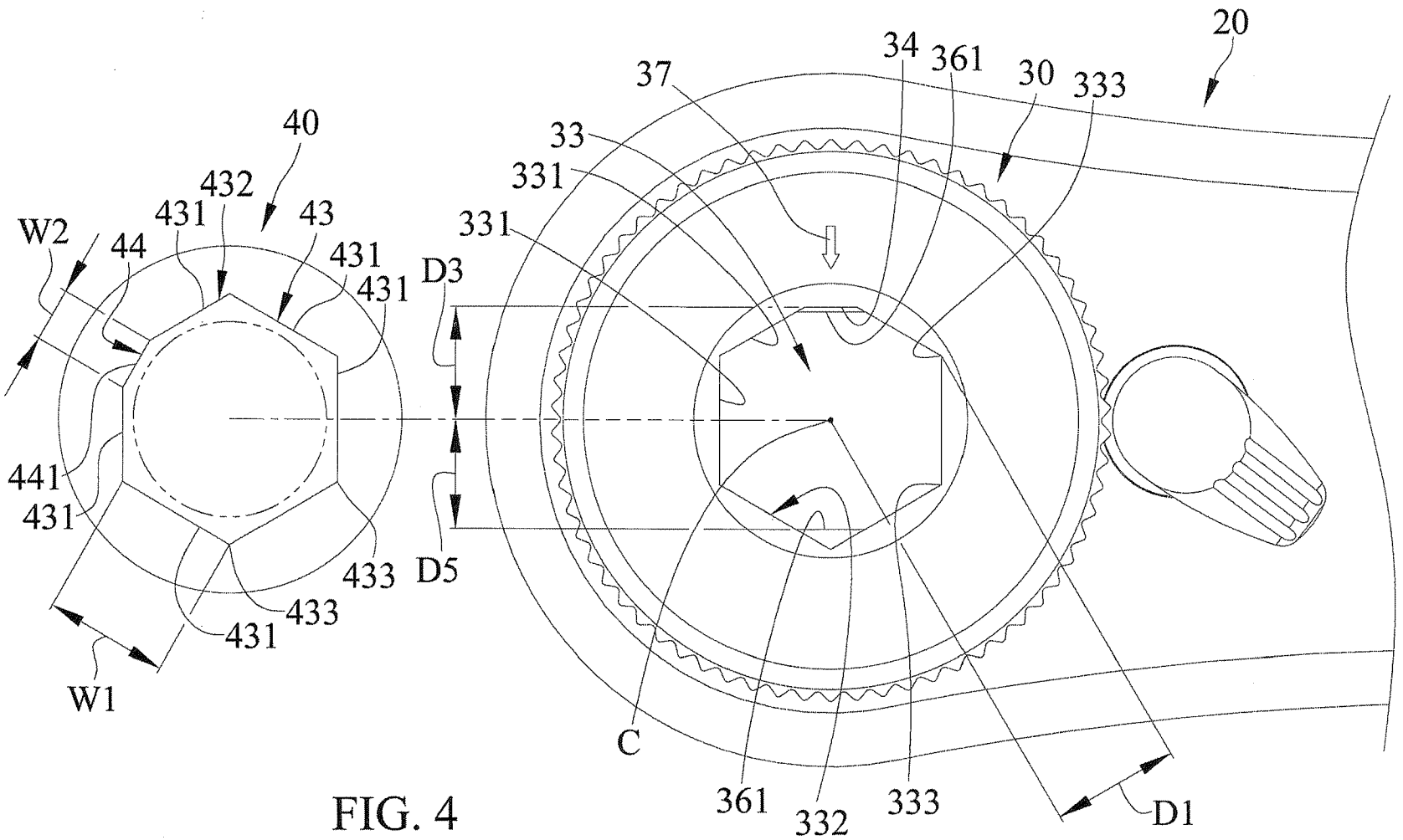
FIG. 4 is a partial, top view of the ratchet wrench and a top view of a driving member of the combination of FIG. 3.
Figure 5:
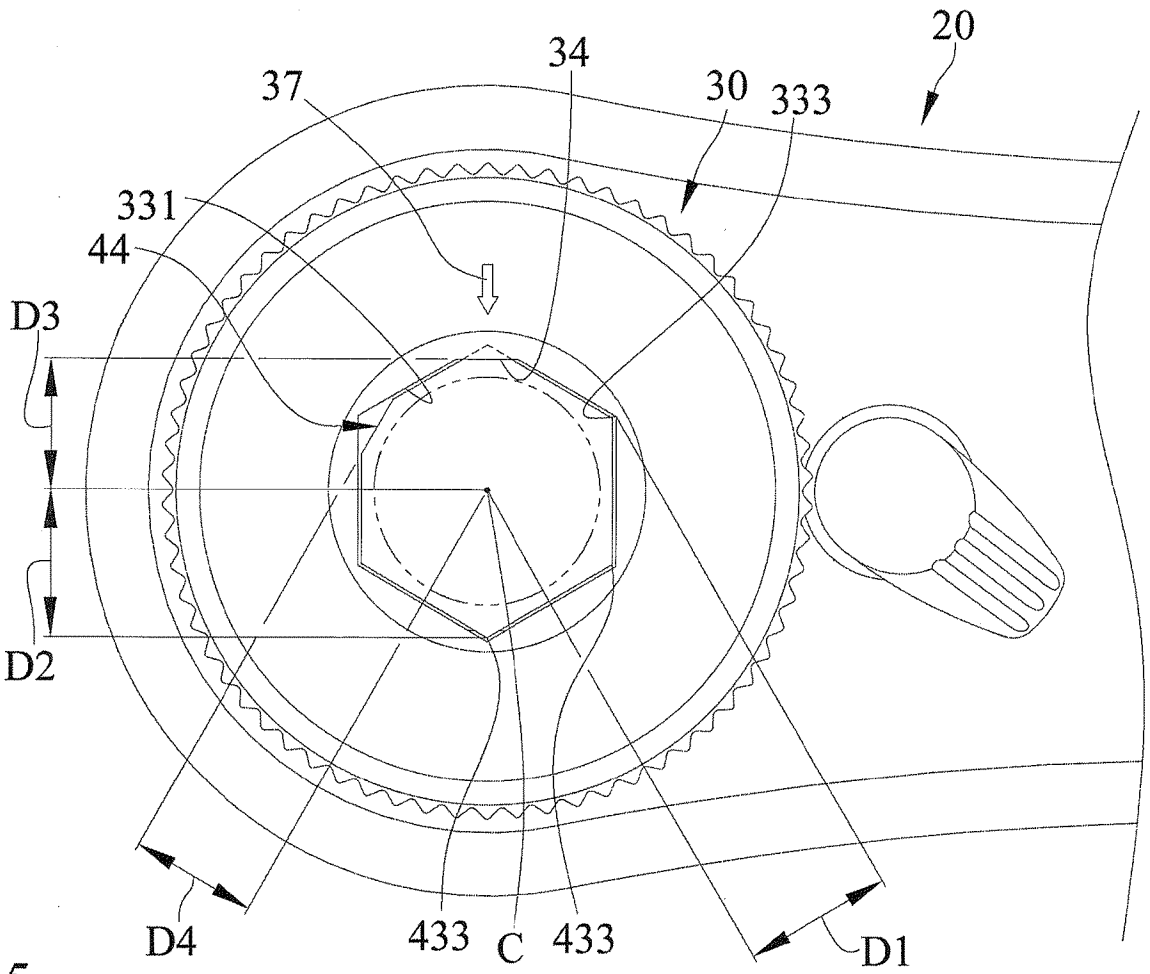
FIG. 5 is a partial, top view of the combination of FIG. 3 with the driving member coupled with the ratchet wrench and with the driving member located in a first coupling position.
Figure 6:
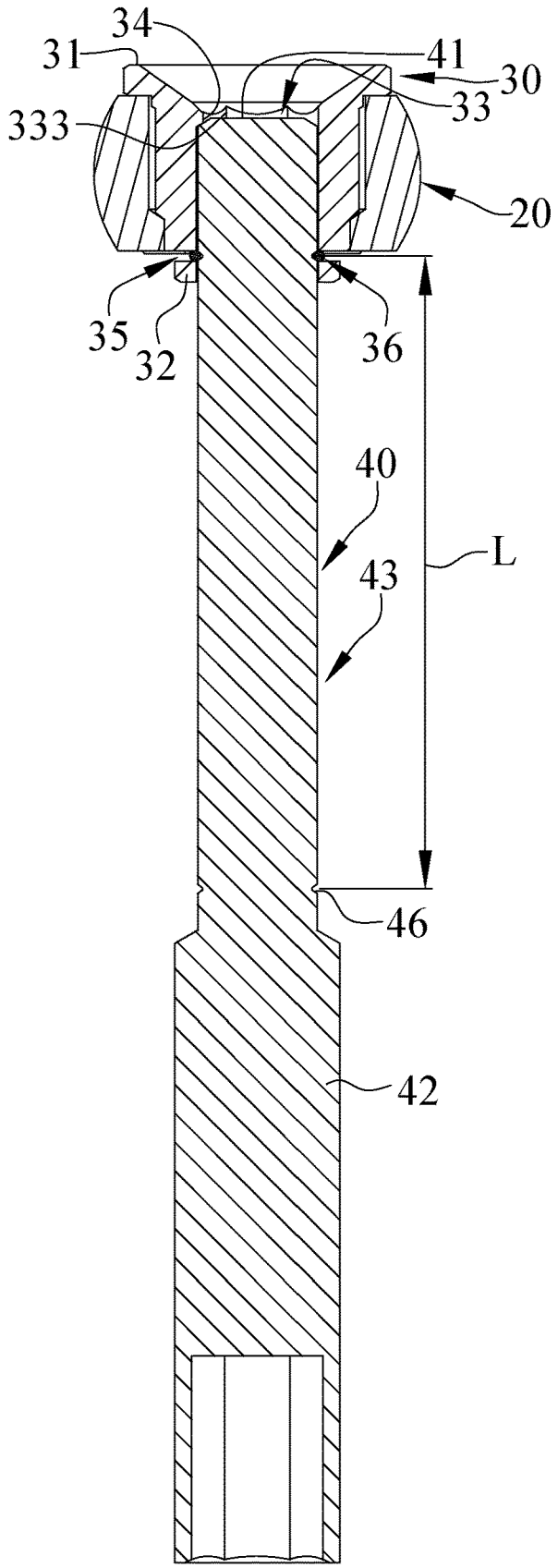
FIG. 6 is a cross sectional view of the combination of FIG. 5.
Figure 7:
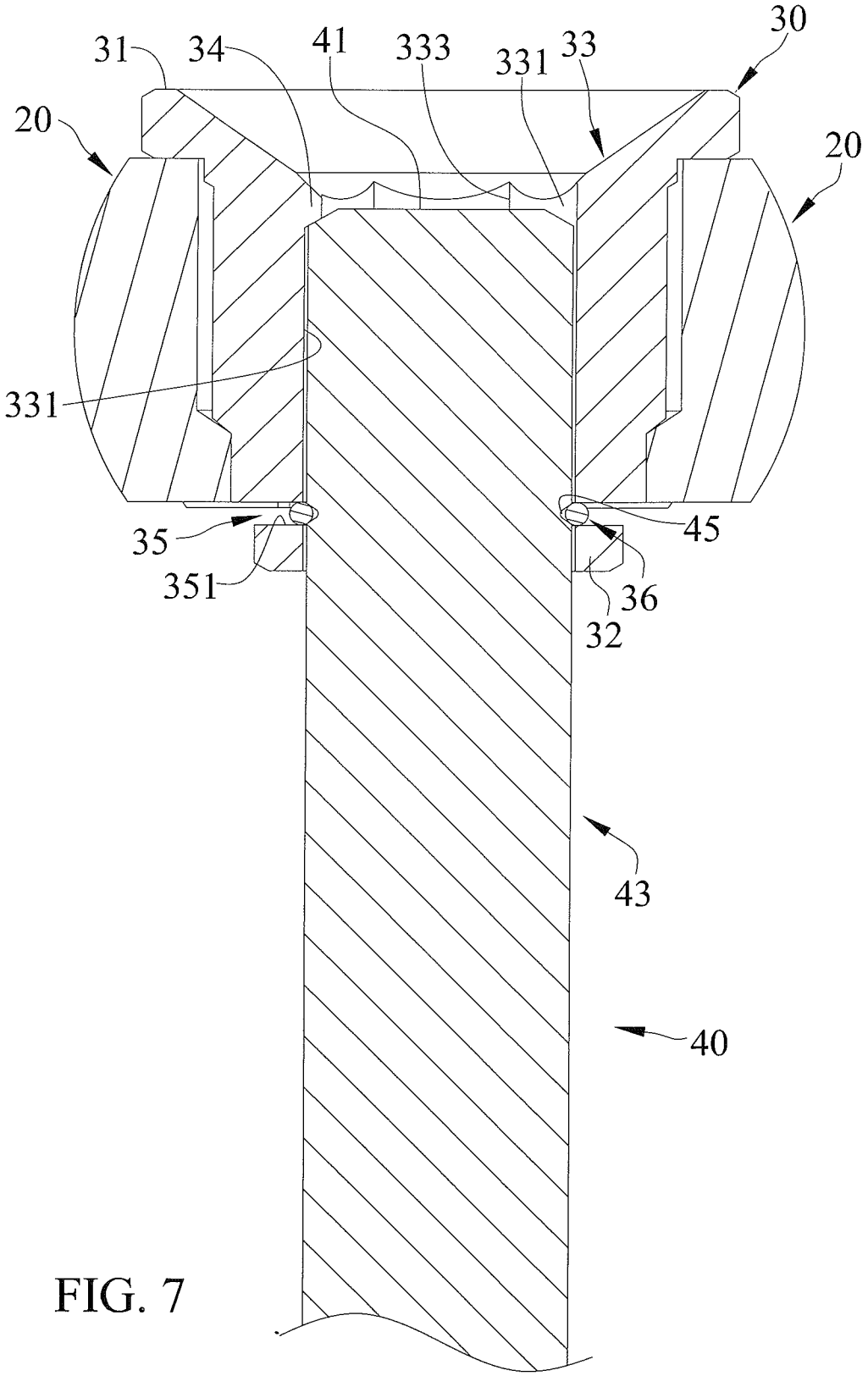
FIG. 7 is an enlarged view of a portion of the combination of FIG. 6.
Figure 8:
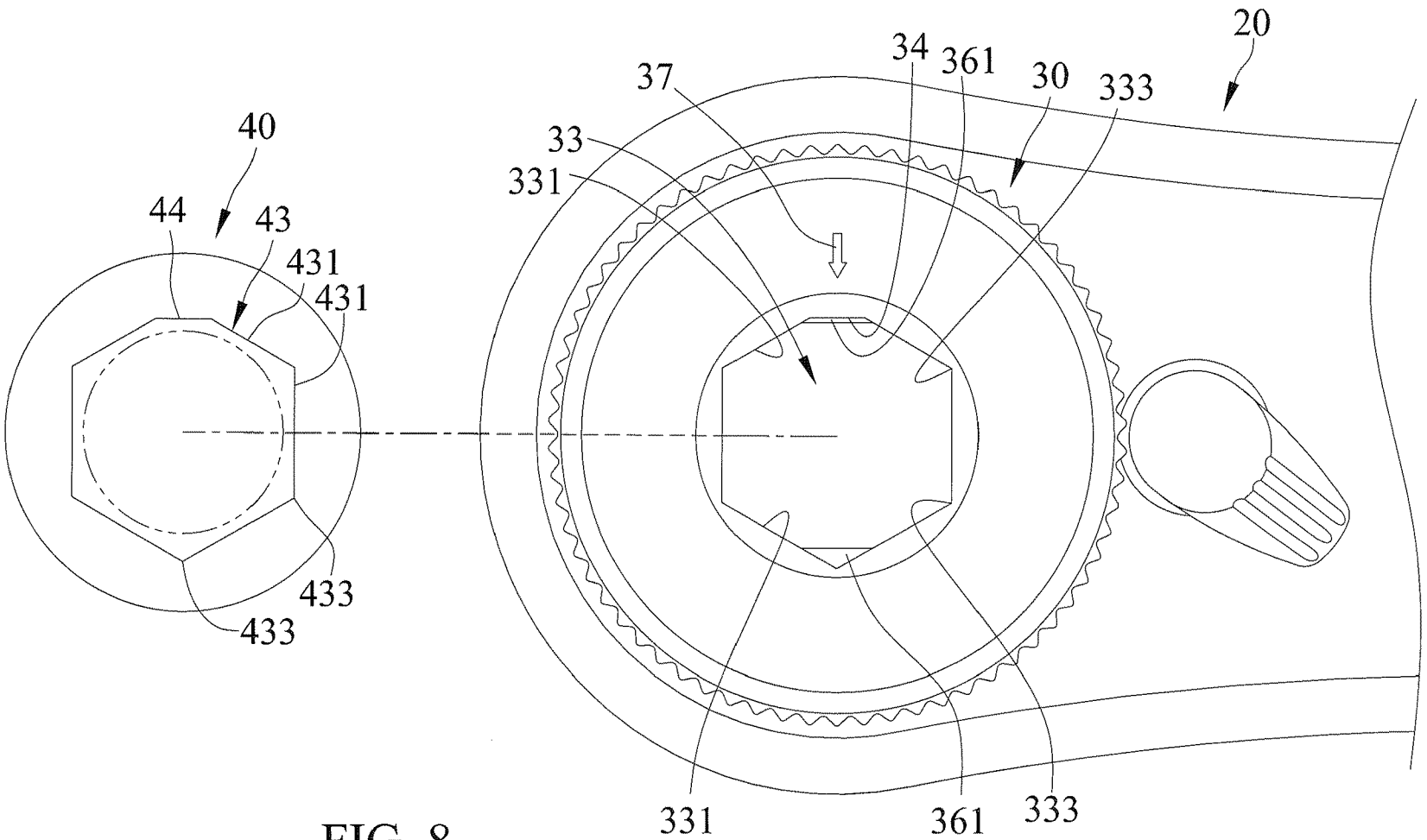
FIG. 8 is a partial, top view of the ratchet wrench and a top view of the driving member of the combination of FIG. 4 with the driving member in a different angular position.
Figure 9:
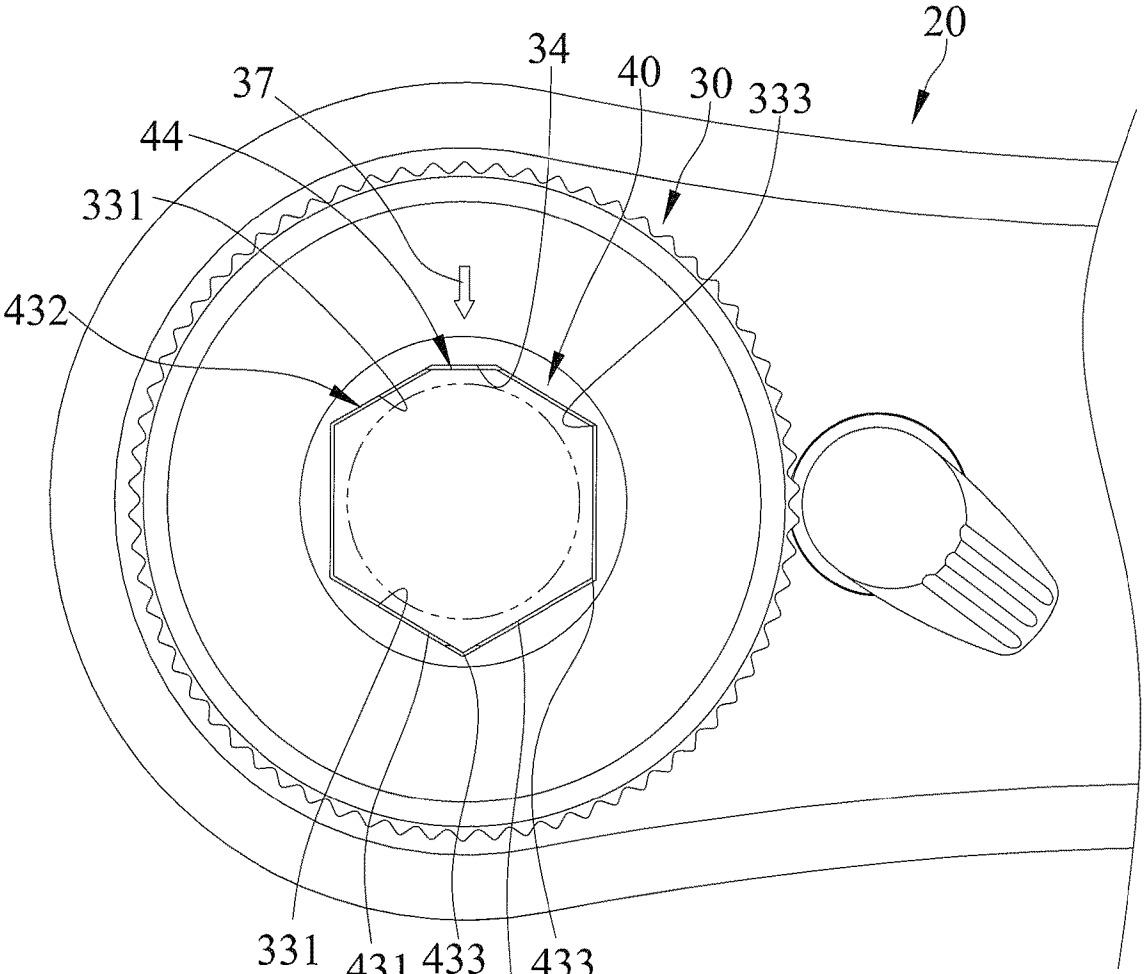
FIG. 9 is a partial, top view of the combination of FIG. 8 with the driving member coupled with the ratchet wrench and with the driving member located in a second coupling position.
Figure 10:
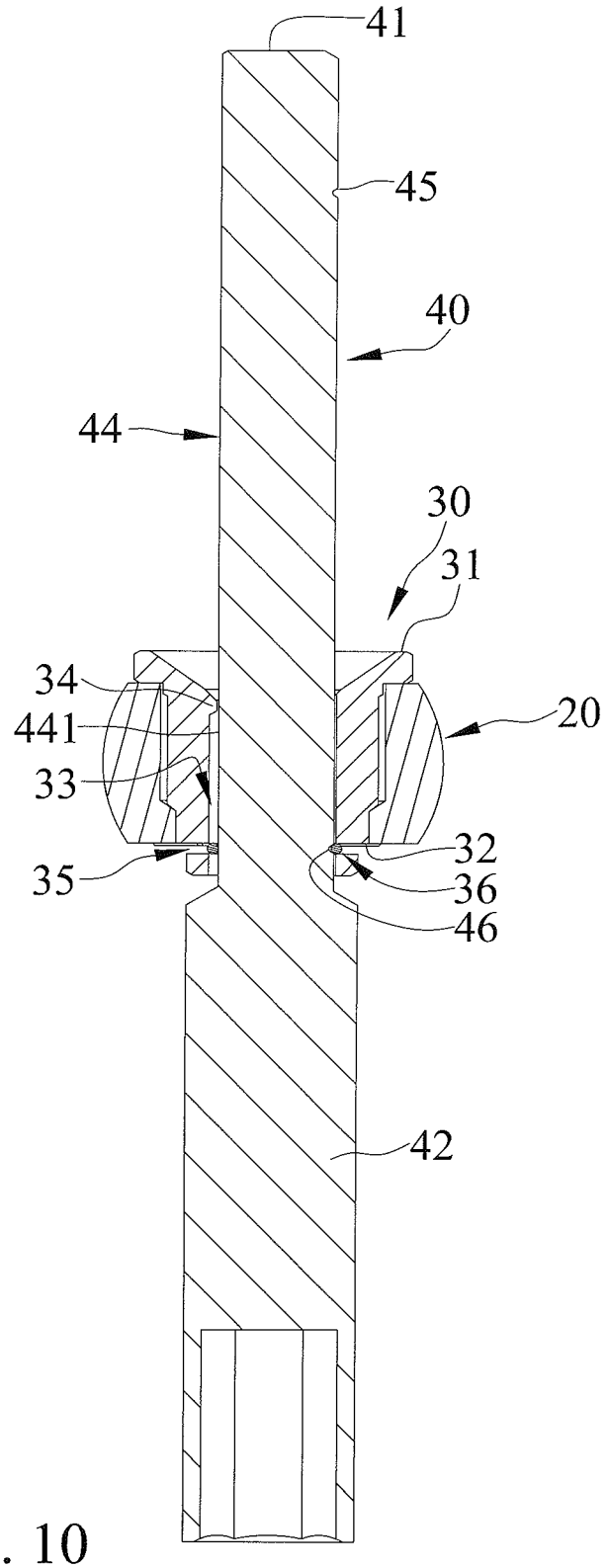
FIG. 10 is a cross sectional view of the combination of FIG. 9.
Figure 11:
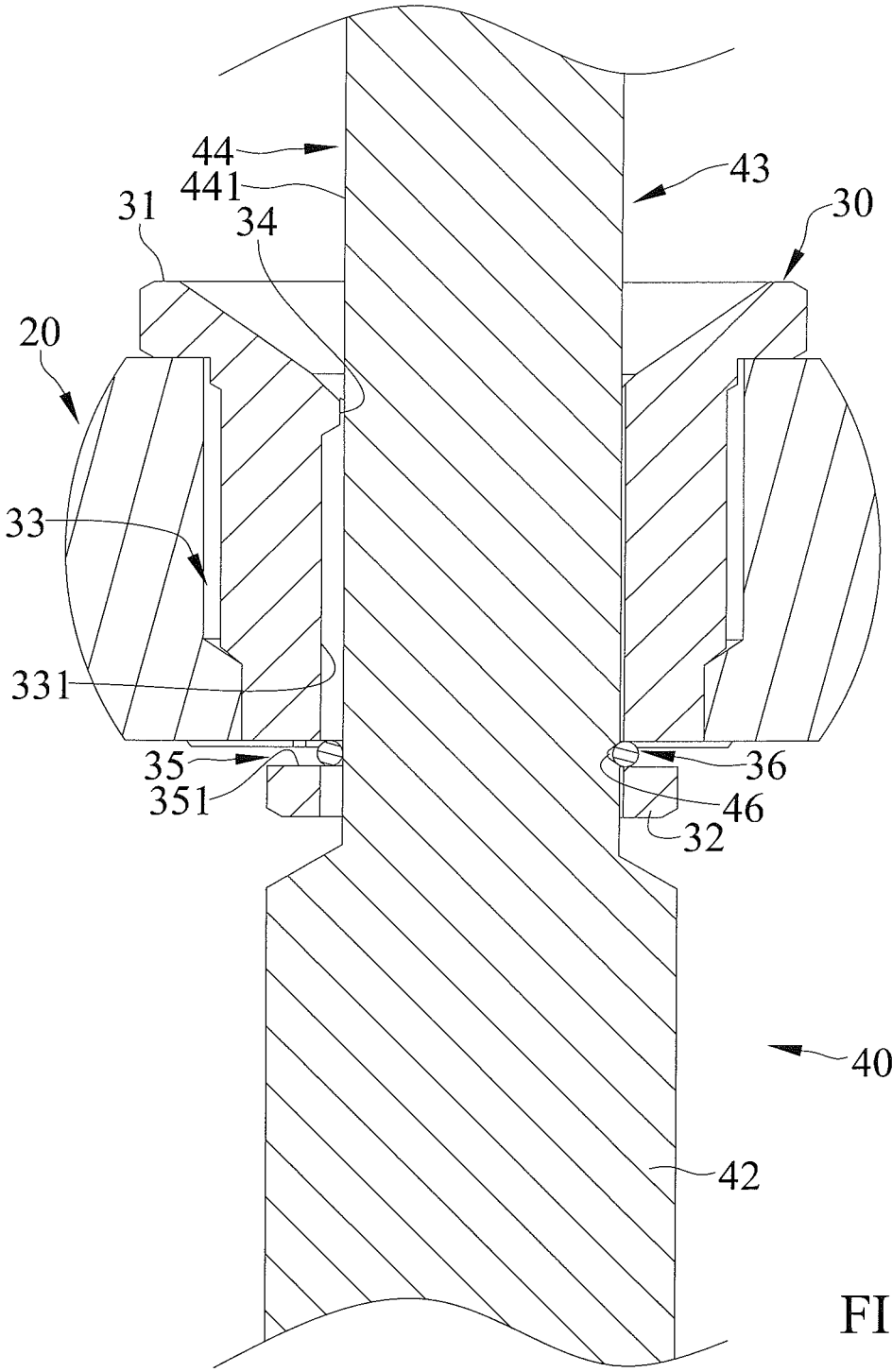
FIG. 11 is an enlarged view of a portion of the combination of FIG. 10.
Figure 12:
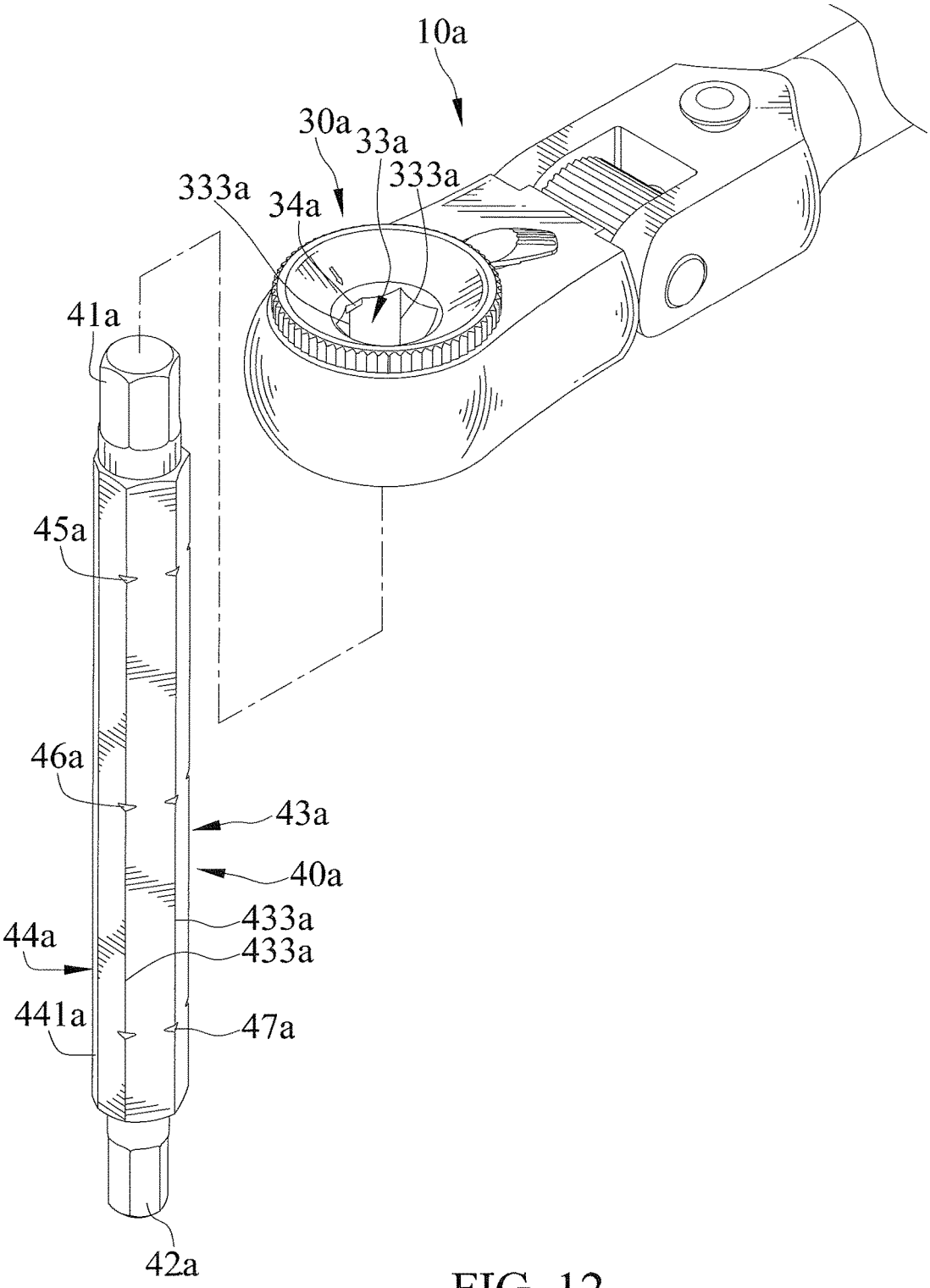
FIG. 12 is an exploded, perspective view of a combination including a ratchet wrench and a driving member of a second embodiment according to the present invention.
Figure 13:
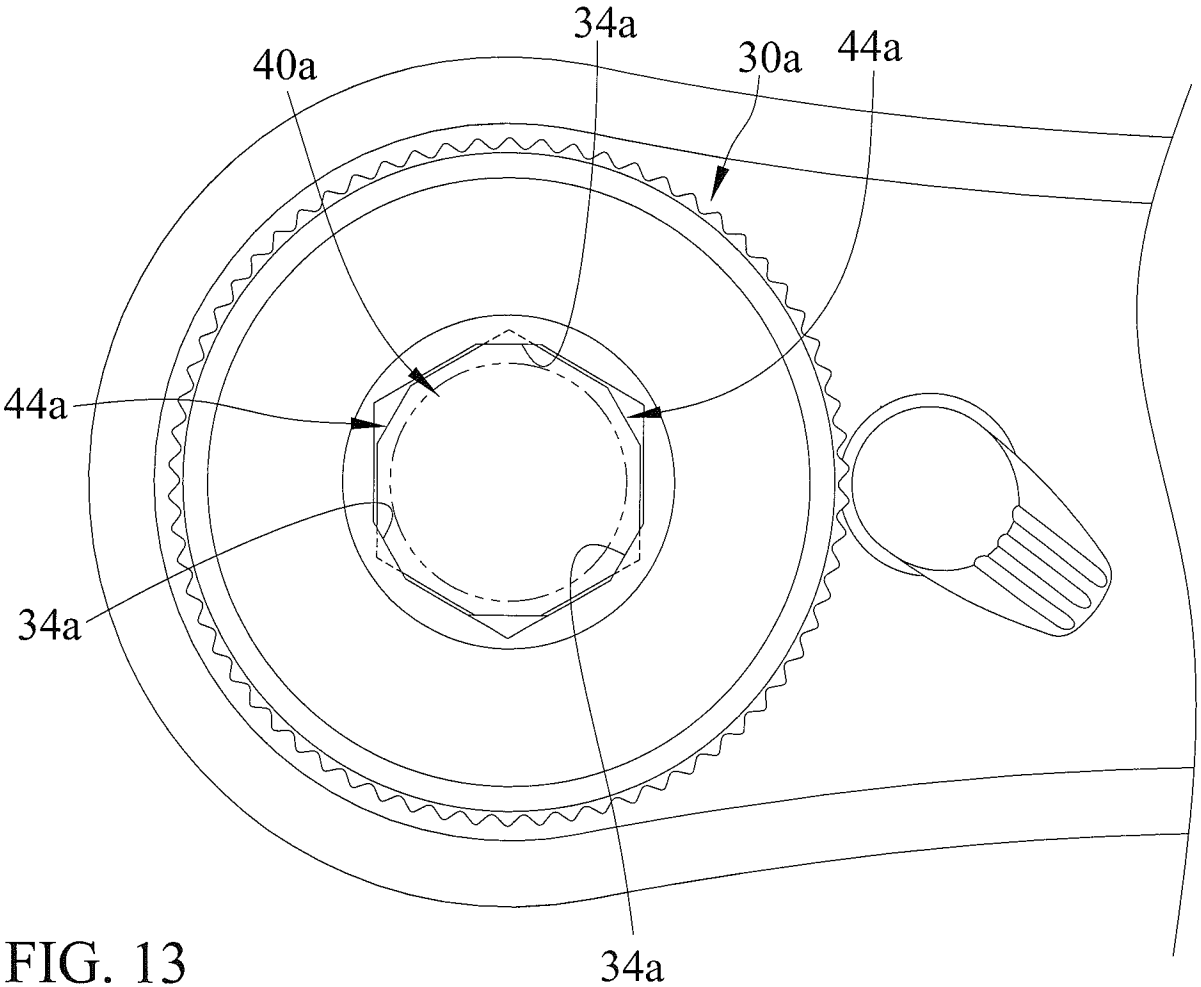
FIG. 13 is a partial, top view of the combination of FIG. 12 with the driving member coupled with the ratchet wrench and with the driving member located in a first coupling position.
Figure 14:
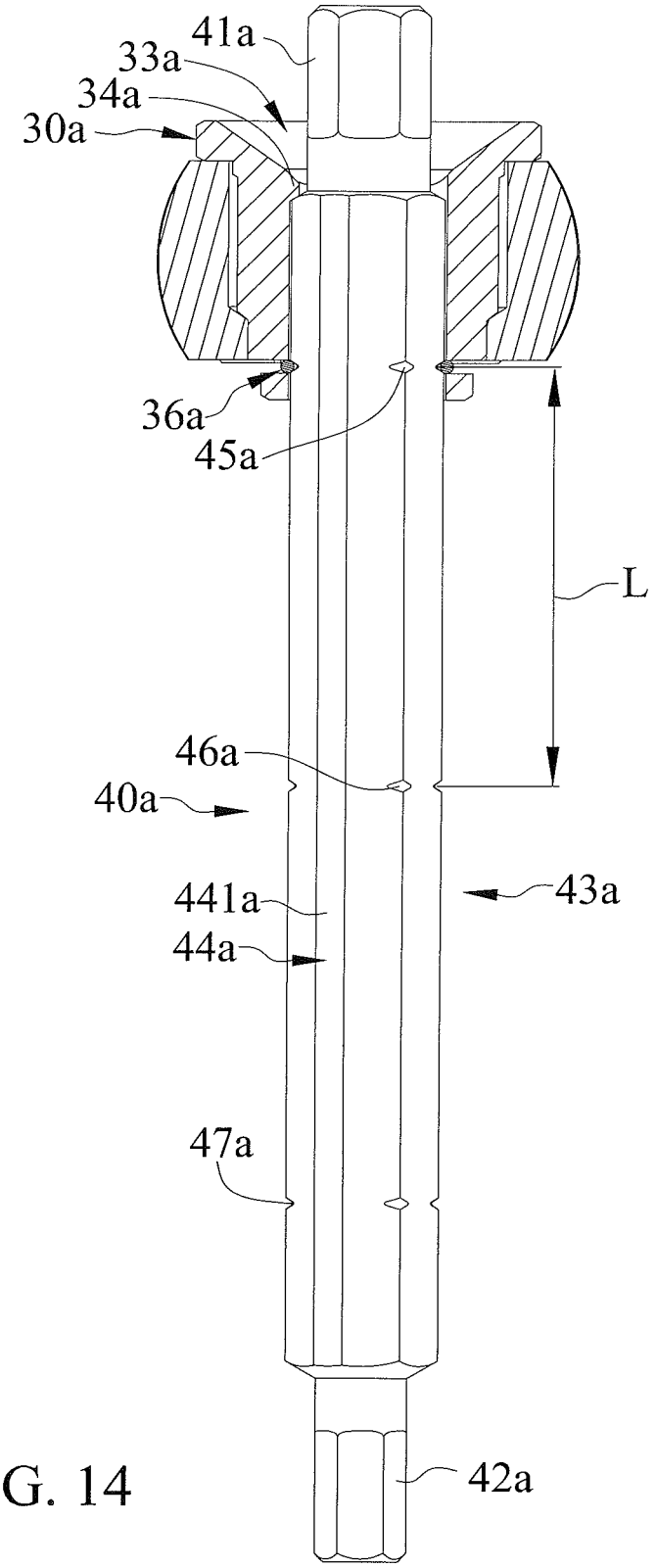
FIG. 14 is a cross sectional view of the combination of FIG. 13.
Figure 15:
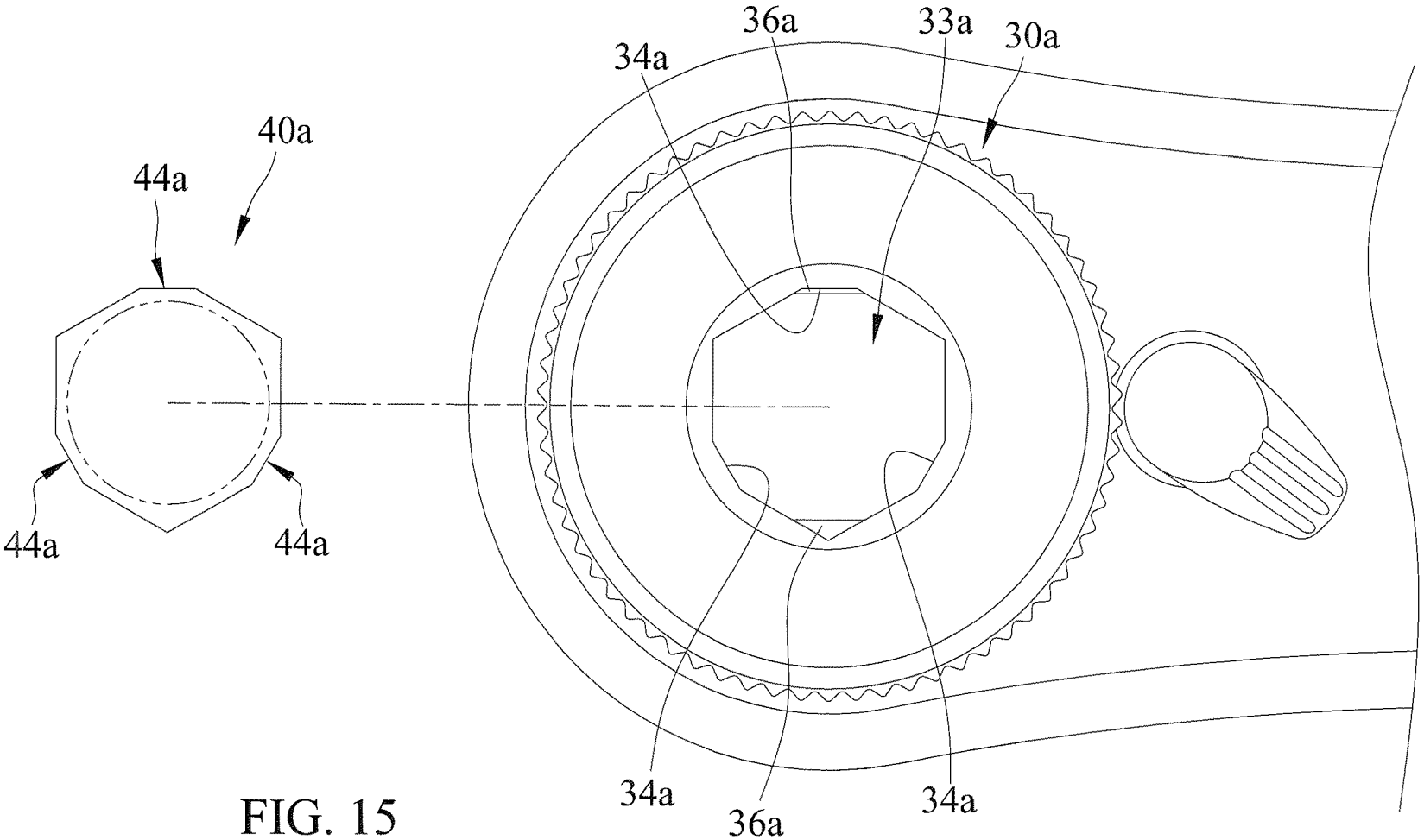
FIG. 15 is a partial, top view of the ratchet wrench and a top view of the driving member of the combination of FIG. 13 with the driving member in a different angular position.
Figure 16:
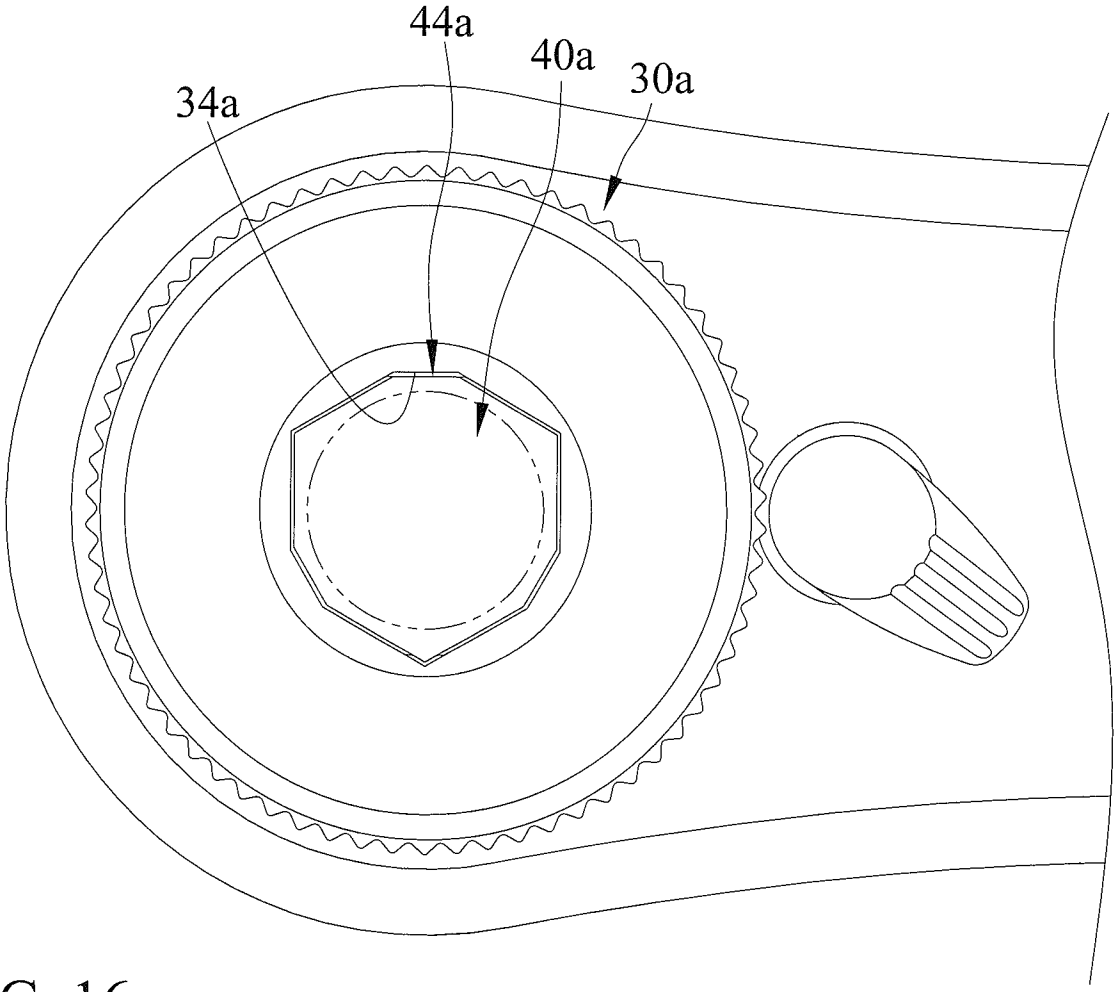
FIG. 16 is a partial, top view of the combination of FIG. 15 with the driving member coupled with the ratchet wrench and with the driving member located in a second coupling position.
Figure 17:
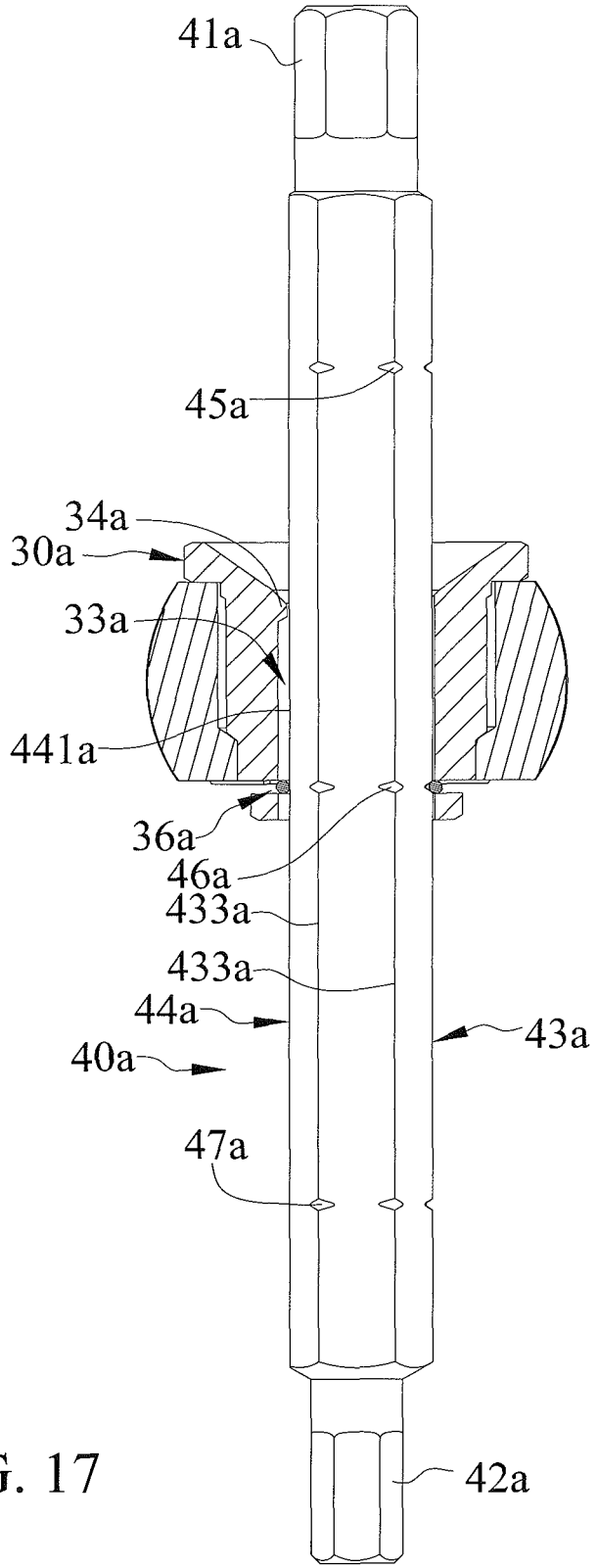
FIG. 17 is a cross sectional view of the combination of FIG. 16.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "end", "portion", "section", "spacing", "length", "width", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-11 show a combination including a ratchet wrench 10 and a driving member 40 of a first embodiment according to the present invention. Ratchet wrench 10 includes a body 20, a ratchet wheel 30, and an operative portion 50.

Body 20 is pivotably connected to operative portion 50 and can be retained in a selected angular position relative to operative portion 50. Operative portion 50 is adapted to be gripped by a user.

Ratchet wheel 30 is mounted in body 20 and is rotatable about a rotational axis C relative to body 20. Ratchet wheel 30 includes a first side 31 and a second side 32 spaced from first side 31 along rotational axis C. Ratchet wheel 30 further includes a driving hole 33 extending from first side 31 through second side 32. Driving hole 33 is polygonal. In this embodiment, driving hole 33 includes an inner periphery 332 having a plurality of abutment surfaces 331 contiguous to each other and arranged along a circumferential direction about rotational axis C. A first corner 333 is formed between each two adjacent abutment surfaces 331 of driving hole 33. Each first corner 333 of driving hole 33 has a first spacing D1 to rotational axis C. The number of first corners 333 of driving holes 33 is equal to the number of abutment surfaces 331 of driving hole 33. In this embodiment, driving hole 33 has six first corners 333. Thus, driving hole 33 is hexagonal.

At least one limiting portion 34 protrudes from inner periphery 332 of driving hole 33 in a radial direction perpendicular to rotational axis C and is formed in at least one of first corners 333. In this embodiment, driving hole 33 includes only one limiting portion 34 located adjacent to first side 31 of ratchet wheel 30. Limiting portion 34 has rectangular cross sections parallel to rotational axis C. Limiting portion 34 has a third spacing D3 to rotational axis C.

Ratchet wheel 30 further includes a retaining groove 35 in an outer periphery thereof. In this embodiment, retaining groove 35 is annular, is located adjacent to second side 32 of ratchet wheel 30, and intercommunicates with driving hole 33. A retainer ring 36 is engaged in retaining groove 35 and extends into driving hole 33 for coupling with driving member 40. Retainer ring 36 is substantially rectangular in shape. Retaining groove 35 includes two coupling sections 351 parallel to each other. Each coupling section 351 intercommunicates with driving hole 33. Retainer ring 36 includes two longer sides 361 and a shorter side 362. Each longer side 361 has first and second ends. Shorter side 362 is interconnected between the first ends of the two longer sides 361. An opening 363 is defined between the second ends of the two longer sides 361. The two longer sides 361 respectively engage with coupling sections 351 of retaining groove 35, extend into driving hole 33, and are located adjacent to second side 32 of ratchet wheel 30. Each longer side 361 of retainer ring 36 has a fifth spacing D5 to rotational axis C. Each longer side 361 has an axial spacing to limiting portion 34 along rotational axis C. An extending direction of each longer side 361 is parallel to an extending direction of limiting portion 34. Shorter side 362 engages with retaining groove 35.

First end 31 of ratchet wheel 30 further includes at least one positioning mark 37 aligned with limiting portion 34 in a radial direction perpendicular to rotational axis C.

Driving member 40 includes a first end 41, a second end 42, and a connecting section 43. In this embodiment, second end 42 of driving member 40 is in the form of a socket for driving a nut, bolt, etc. Connecting section 43 is located between and integrally formed with first and second ends 41 and 42.

Connecting section 43 includes an outer periphery 432 having a plurality of abutment faces 431 contiguous to each other. A second corner 433 is formed between each two adjacent abutment faces 431 of connecting section 43. Each second corner 433 of connecting section 43 has a second spacing D2 to rotational axis C. The number of second corners 433 of connecting section 43 is equal to the number of abutment faces 431 of connecting section 43. In this embodiment, connecting section 43 has six corners 433 and six abutment faces 431. Each abutment face 431 of connecting section 43 has a first width W1.

Connecting section 43 further includes at least one evasive portion 44 extending from first end 41 to second end 42 of driving member 40. In this embodiment, connecting section 43 includes only one evasive portion 44 located in one of second corners 433 and between two adjacent abutment faces 431. Evasive portion 44 includes a fourth spacing D4 to rotational axis C. First spacing D1 is larger than second spacing D2, second spacing D2 is larger than third spacing D3, third spacing D3 is larger than fourth spacing D4, and fourth spacing D4 is larger than fifth spacing D5. Evasive portion 44 includes an evasive face 441 having two sides respectively connected to the two adjacent abutment faces 431. Each of the two sides of evasive face 441 of evasive portion 44 is at a first angle to a corresponding one of the two adjacent abutment faces 431. Each second corner 433 of connecting section 43 has a second angle smaller than the first angle. Evasive face 441 of evasive portion 44 has a second width W2 smaller than first width W1.

Connecting section 43 of driving member 40 includes at least two first coupling grooves 45 respectively defined in at least two second corners 433 and at least two second coupling grooves 46 respectively defined in at least two second corners 433. First coupling grooves 45 are located adjacent to first end 41 of driving member 40. Second coupling grooves 46 are located adjacent to second end 42 of driving member 40. Each first coupling groove 45 is spaced from each second coupling groove 46 by a length L along rotational axis C. In this embodiment, connecting section 43 includes four first coupling grooves 45 and four second coupling grooves 46.

Connecting section 43 can be inserted into driving hole 33 of ratchet wheel 30 along rotational axis C. Abutment faces 431 of connecting section 43 abut abutment surfaces 331 of driving hole 33. Connecting section 43 is selectively located in one of a first coupling position and a second coupling position relative to ratchet wheel 30. When driving member 40 is in the first coupling position, evasive portion 44 is not aligned with limiting portion 34, and first end 41 of driving member 40 abuts limiting portion 34 of ratchet wheel 30. The two longer sides 361 of retainer ring 36 engage with two of first coupling grooves 45. On the other hand, when driving member 40 is in the second coupling position, evasive portion 44 is aligned with limiting portion 34, the two longer sides 361 of retainer ring 36 engage with two of second coupling grooves 46, and first end 41 and second end 42 of driving member 40 are located on two sides of ratchet wheel 30 along rotational axis C. When driving member 40 moves from the first coupling position to the second coupling position or from the second coupling position to the first coupling position, driving member 40 moves relative to ratchet wheel 30 by a distance along rotational axis C equal to length L.

By the provision of driving member 40 selectively in the first or second coupling position relative to ratchet wheel 30, ratchet wrench 10 can adjust the length of driving member 40 extending beyond ratchet wheel 30, which is advantageous in use with holes of various depths, permitting convenient operation by the user. During adjustment of the coupling position of driving member 40, driving member 40 can be rotated through an angle and then moved along rotational axis C by length L to switch between the first and second coupling positions, allowing rapid and convenient operation.

FIGS. 12-17 show a combination including a ratchet wrench 10*a* and a driving member 40*a* of a second embodiment according to the present invention. The second embodiment is substantially the same as the first embodiment. The main differences are that driving hole 33*a* of ratchet wheel 30*a* includes three limiting portions 34*a* respectively located in three of six first corners 333*a* not adjacent to each other.

First end 41*a* and second end 42*a* of driving member 40*a* can be of different sizes for driving screws of different sizes. Connecting section 43*a* of driving member 40*a* has three evasive portions 44*a* respectively located in three of six second corners 433*a* not adjacent to each other. Connecting section 43*a* includes at least two first coupling grooves 45*a*, at least two second coupling grooves 46*a*, and at least two third coupling grooves 47*a*. First coupling grooves 45*a* are located between second coupling grooves 46*a* and first end 41*a* of driving member 40*a*. Third coupling groove 47*a* are located between second end 42*a* of driving member 40*a* and second coupling grooves 46*a*. Each first coupling groove 45*a* is spaced from each second coupling groove 46*a* by a length L along rotational axis C. In this embodiment, connecting section 43*a* includes four first coupling grooves 45*a*, four second coupling grooves 46*a*, and four third coupling grooves 47*a*.

Connecting section 43*a* of driving member 40*a* is inserted into driving hole 33*a* and is selectively located in one of a first coupling position and a second coupling position relative to ratchet wheel 30*a*. When driving member 40*a* is in the first coupling position, the three evasive portions 44*a* having the evasive face 441*a* are not aligned with the three limiting portions 34, and first end 41*a* of driving member 40*a* abuts the three limiting portions 34*a* of ratchet wheel 30*a*. The two longer sides 361 of retainer ring 36 engage with two of first coupling grooves 45*a*. On the other hand, when driving member 40*a* is in the second coupling position, the three evasive portions 44 are aligned with the three limiting portions 34, and the two longer sides 361 of retainer ring 36 engage with two of second coupling grooves 46*a*. When driving member 40*a* moves from the first coupling position to the second coupling position or from the second coupling position to the first coupling position, driving member 40*a* moves relative to ratchet wheel 30*a* by a distance along rotational axis C equal to length L.

Furthermore, second end 42*a* of driving member 40*a* can be inserted into driving hole 33*a* of ratchet wheel 30*a* with retainer ring 36*a* engaged with third coupling grooves 47*a*.

By the provision of three limiting portions 34*a* and three evasive portions 44*a*, driving member 40*a* can be switched between the first and second coupling positions relative to ratchet wheel 30*a* by only rotating through 60°, such that the user does not have to check the position of driving member 40*a* for assembly purposes, increasing operational convenience. Furthermore, first end 41*a* and second end 42*a* of driving member 40*a* can be of different sizes for driving screws of different sizes, providing driving member 40*a* with enhanced utility.

Figure 18:
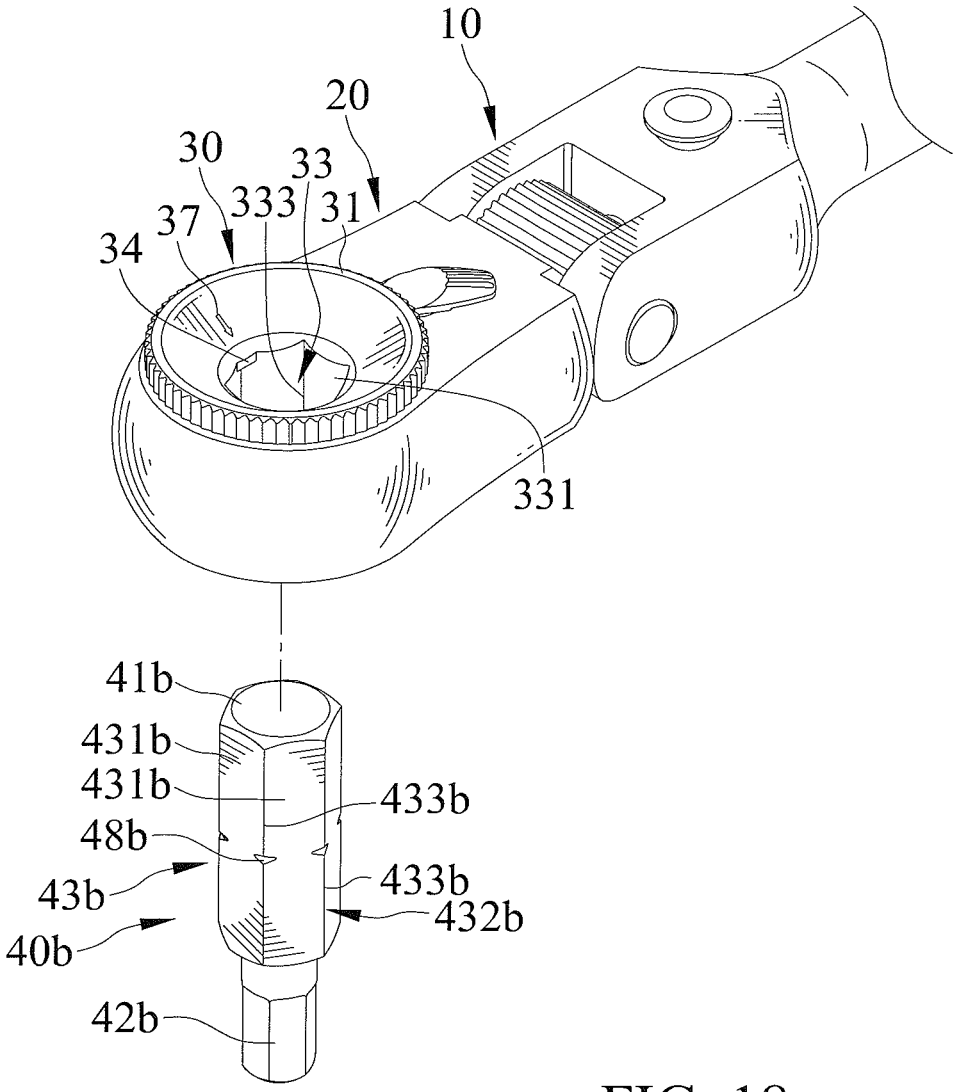
FIG. 18 is an exploded, perspective view of a combination of a third embodiment according to the present invention.
Figure 19:
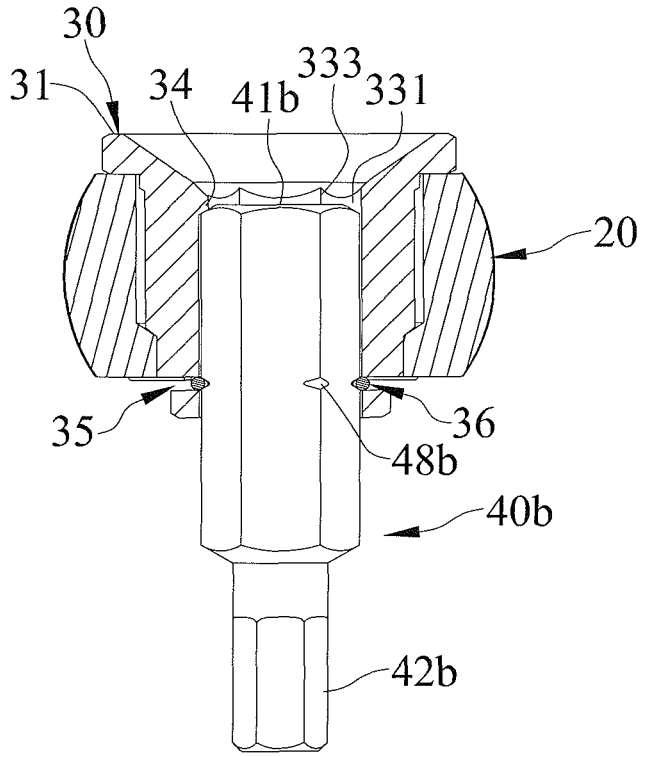
FIG. 19 is a cross sectional view of the combination of FIG. 18.

FIGS. 18 and 19 show a combination of a ratchet wrench 10 and a driving member 40*b* of a third embodiment according to the present invention. The third embodiment is substantially the same as the first embodiment. The main differences are that driving member 40*b* is in the form of a bit including first and second ends 41*b* and 42*b*, with second end 42*b* being an operative end for driving a screw. Driving member 40*b* further includes a connecting section 43*b* located between first end 41*b* and second end 42*b*. Connecting section 43*b* includes an outer periphery 432*b* having a plurality of abutment faces 431*b*. A corner 433*b* is formed between each two adjacent abutment faces 431*b*. The number of corners 433*b* is the same as the number of the abutment faces 431*b*. In this embodiment, connecting section 43*b* includes six abutment faces 431*b*.

Connecting section 43*b* of driving member 40*b* includes at least two coupling grooves 48*b* located between first end 41*b* and second end 42*b* of driving member 40*b*. In this embodiment, connecting section 43*b* includes four coupling grooves 48*b*. Connecting section 43*b* of driving member 40*b* is detachably inserted into driving hole 33 of ratchet wheel 30 with abutment faces 431*b* of connecting section 43*b* abutting abutment surfaces 331 of driving hole 33. First end 41*b* of driving member 40*b* abuts limiting portion 34. Retainer ring 36 engages with coupling grooves 48*b*. Movement of driving member 40*b* relative to ratchet wheel 30 is avoided. Thus, driving member 40*b* cannot pass through driving hole 33 along rotational axis C in any angular position relative to ratchet wheel 30.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A combination comprising a ratchet wrench and a driving member, with the ratchet wrench including:

a body; and a ratchet wheel mounted in the body and rotatable about a rotational axis relative to the body, with the ratchet wheel including a first side and a second side spaced from the first side along the rotational axis, with the ratchet wheel further including a driving hole extending from the first side through the second side, with the driving hole including an inner periphery having a plurality of abutment surfaces contiguous to each other and arranged along a circumferential direction about the rotational axis, with a first corner formed between each two adjacent abutment surfaces of the driving hole, with at least one limiting portion integrally protruding from the inner periphery of the driving hole in a radial direction perpendicular to the rotational axis and extending into the driving hole into at least one of the first corners, with the driving member including a first end, a second end, and a connecting section, with the connecting section including an outer periphery having a plurality of abutment faces contiguous to each other and slideably inserted in the plurality of abutment surfaces of the driving hole, with a second corner formed between each two adjacent abutment faces of the connecting section, with the connecting section including at least one evasive portion between two adjacent abutment faces, with the at least one evasive portion including an evasive face having two sides respectively connected to the two adjacent abutment faces, with the connecting section adapted to be inserted into the driving hole of the ratchet wheel by extending along the rotational axis, with the plurality of abutment faces of the connecting section abutting the plurality of abutment surfaces of the driving hole, and with the connecting section inserted into the driving hole and located in one of a first coupling position and a second coupling position in the ratchet wheel with the evasive face being in rotationally spaced positions about the rotational axis in the first and second coupling positions, wherein the connecting section of the driving member is inserted into the driving hole to abut one of the second corners of the driving member with the at least one limiting portion of the ratchet wheel in the first coupling position, and the at least one evasive portion inserted into the driving hole is not aligned with the at least one limiting portion in the first coupling position, and wherein the connecting section of the driving member is inserted into the driving hole with all of the second corners of the driving member not abutting the at least one limiting portion of the ratchet wheel in the second coupling position, and all of the at least one evasive portion inserted into the driving hole are aligned with all of the at least one limiting portion to cause the connecting section of the driving member to pass through the driving hole of the ratchet wheel in the second coupling position, and the first end and the second end of the driving member are respectively located on the first side and the second side of the ratchet wheel along the rotational axis in the second coupling position.

2. The combination as claimed in claim 1, with a number of the first corners of the driving holes equal to a number of the plurality of abutment surfaces of the driving hole, with a number of the second corners of the connecting section equal to a number of the plurality of abutment faces of the connecting section, with the at least one limiting portion located adjacent to the first side of the ratchet wheel, with the ratchet wheel further including a retaining groove in an outer periphery thereof, with the retaining groove located adjacent to the second side of the ratchet wheel and intercommunicated with the driving hole, and with a retainer ring engaged in the retaining groove and extending into the driving hole.

3. The combination as claimed in claim 2, with the retaining groove including two coupling sections parallel to each other, with each of the two coupling sections intercommunicated with the driving hole, with the retainer ring including two longer sides and a shorter side, with each of the two longer sides having first and second ends, with the shorter side interconnected between the first ends of the two longer sides, with an opening defined between the second ends of the two longer sides, with the two longer sides respectively engaged with the two coupling sections of the retaining groove and extending into the driving hole, with each of the two longer sides having an axial spacing to the at least one limiting portion along the rotational axis, with an extending direction of each of the two longer sides parallel to an extending direction of the at least one limiting portion, with the shorter side engaged with the retaining groove, with the connecting section of the driving member including at least two first coupling grooves respectively defined in at least two of the second corners and at least two second coupling grooves respectively defined in at least two of the second corners, and with each of the at least two first coupling grooves spaced from each of the at least two second coupling grooves by a length along the rotational axis, wherein when the driving member is in the first coupling position, the two longer sides engage with the at least two first coupling grooves, wherein when the driving member is in the second coupling position, the two longer sides engage with the at least two second coupling grooves, and wherein when the driving member moves from the first coupling position to the second coupling position or from the second coupling position to the first coupling position, the driving member moves relative to the ratchet wheel by a distance along the rotational axis equal to the length.

4. The combination as claimed in claim 3, with the connecting section located between the first end and the second end of the driving member, with each of the plurality of abutment faces of the connecting section having a first width, and with the evasive face of the at least one evasive portion having a second width smaller than the first width.

5. The combination as claimed in claim 4, with the at least one evasive portion extending from the first end to the second end of the driving member, with each of the two sides of the evasive face of the at least one evasive portion being at a first angle to a corresponding one of the two adjacent abutment faces, and with each second corner of the connecting section having a second angle smaller than the first angle.

6. The combination as claimed in claim 3, wherein the at least one limiting portion has rectangular cross sections parallel to the rotational axis.

7. The combination as claimed in claim 3, with each first corner of the driving hole having a first spacing to the rotational axis, with each second corner of the connecting section having a second spacing to the rotational axis, with the at least one limiting portion of the ratchet wheel having a third spacing to the rotational axis, with the at least one evasive portion of the driving member including a fourth spacing to the rotational axis, with each of the two longer sides of the retainer ring having a fifth spacing to the rotational axis, with the first spacing larger than the second spacing, with the second spacing larger than the third spacing, with the third spacing larger than the fourth spacing, and with the fourth spacing larger than the fifth spacing.

8. The combination as claimed in claim 1, with the at least one limiting portion including three limiting portions, with the plurality of abutment surfaces having six abutment surfaces, with the driving hole having six first corners, with the three limiting portions respectively located in three of the six first corners not adjacent to each other, with the plurality of abutment faces having six abutment faces, with the connecting section having six second corners, with the at least one evasive portion including three evasive portions, and with the three evasive portions respectively located in three of the six second corners not adjacent to each other.

9. The combination as claimed in claim 8, with the connecting section further including at least one third coupling groove in one of the six second corners, with the at least two first coupling grooves located between the at least two second coupling grooves and the first end of the driving member, and with the at least one third coupling groove located between the second end of the driving member and the at least two second coupling grooves.

10. The combination as claimed in claim 1, with the ratchet wheel further including an operative portion, and with the body pivotably connected to the operative portion and positionable relative to the operative portion.

* * * * *